US006065375A

United States Patent [19]

Leonard

[11] Patent Number: 6,065,375

[45] Date of Patent: May 23, 2000

[54] TOOL FOR MANUALLY TURNING DIESEL ENGINES

[76] Inventor: James D. Leonard, 1316 Edgewood Dr., Alhambra, Calif. 91803

[21] Appl. No.: 09/053,174

[22] Filed: Apr. 1, 1998

[51] Int. Cl.[7] ..... B25B 13/48

[52] U.S. Cl. ..... 81/76; 81/129; 74/545

[58] Field of Search ..... 81/75, 76, 129, 81/176.1, 176.2, 176.3, 484, 488; 74/545; 192/45.2

[56] References Cited

U.S. PATENT DOCUMENTS 257,691 5/1882 Gatchell ..... 74/545
761,523 5/1904 Miller, Jr. ..... 81/176.2
4,564,991 1/1986 Taylor ..... 29/426.5

*Primary Examiner*—David A. Scherbel
*Assistant Examiner*—Philip J Hoffmann
*Attorney, Agent, or Firm*—Robert M. Sperry

[57] ABSTRACT

A hand tool for enabling a mechanic to manually rotate a diesel engine, said tool comprising an elongated generally L-shaped handle having a flange located at the lower end thereof and having toothed wheel secured to said handle at a point spaced from said flange a distance such that when said flange is inserted into the recess of a diesel engine damper, said toothed wheel will rest on the outer surface of said damper and, when said tool is rotated, said flange and said wheel will clamp said damper therebetween to enable the mechanic to manually rotate said damper and said engine.

8 Claims, 2 Drawing Sheets

TOOL FOR MANUALLY TURNING DIESEL ENGINES

FIELD OF INVENTION

This invention relates to hand tools and is particularly directed to improved hand tools for turning the crankshafts of diesel engines and the like.

PRIOR ART

During the servicing of diesel engines and the like, it often becomes necessary or desirable for the mechanic to manually turn the engine crankshaft. Unfortunately, the compression of diesel engines is extremely high and no means is provided for manually rotating the engine crankshaft. In the past, such rotation has been accomplished by momentarily actuating the engine starter. This serves to rotate the engine, but does not permit precision movement. Thus, no satisfactory means has been provided in the prior art for manually rotating a diesel engine crankshaft.

BRIEF SUMMARY AND OBJECTS OF INVENTION

These disadvantages of the prior art are overcome with the present invention and a tool is provided which enables a mechanic to quickly and easily rotate a diesel engine with extreme accuracy without modification of the engine and with a tool which is simple and inexpensive to produce and purchase and which requires little or no maintenance.

These advantages of the present invention are preferably attained by providing a hand tool for enabling a mechanic to manually rotate a diesel engine, said tool comprising an elongated generally L-shaped handle having a flange located at the lower end thereof and having toothed wheel secured to said handle at a point spaced from said flange a distance such that when said flange is inserted into the recess of a diesel engine damper, said toothed wheel will rest on the outer surface of said damper and, when said tool is rotated, said flange and said wheel will clamp said damper therebetween to enable the mechanic to manually rotate said damper and said engine.

Accordingly, it is an object of the present invention to provide a tool enabling a mechanic to manually rotate an diesel engine.

Another object of the present invention is to provide a tool which enables a mechanic to quickly and easily rotate a diesel engine.

An additional object of the present invention is to provide a tool which enables a mechanic to quickly and easily rotate a diesel engine with extreme accuracy.

A further object of the present invention is to provide a tool which enables a mechanic to quickly and easily rotate a diesel engine with extreme accuracy without modification of the engine.

Another to quickly and easily rotate a diesel engine with extreme accuracy, which tool is simple and inexpensive to produce and purchase and which requires little or no maintenance.

A specific object of the present invention is to provide a tool is provided which enables a mechanic to quickly and easily rotate a diesel engine with extreme accuracy without modification of the engine and with a tool which is simple and inexpensive to produce and purchase and which requires little or no maintenance.

These advantages of the present invention are preferably attained by providing a hand tool for enabling a mechanic to manually rotate a diesel engine, said tool comprising an elongated generally L-shaped handle having a flange located at the lower end thereof and having toothed wheel secured to said handle at a point spaced from said flange a distance such that when said flange is inserted into the recess of a diesel engine damper, said toothed wheel will rest on the outer surface of said damper and, when said tool is rotated, said flange and said wheel will clamp said damper therebetween to enable the mechanic to manually rotate said damper and said engine.

These and other objects and features of the present invention will be apparent from the following detailed description, taken with reference to the figures of the accompanying drawing.

DETAILED DESCRIPTION OF THE INVENTION

Figure 1:
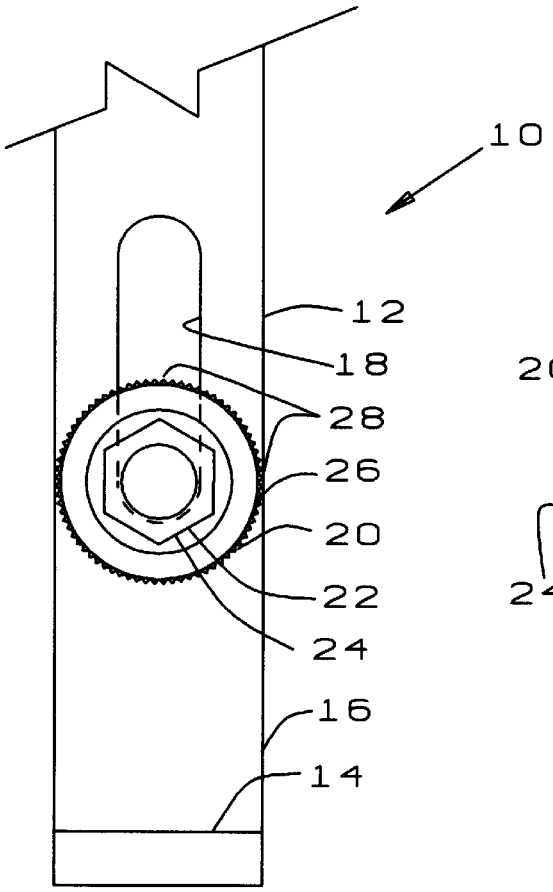
FIG. 1 is a side view of a tool embodying the present invention.
Figure 2:
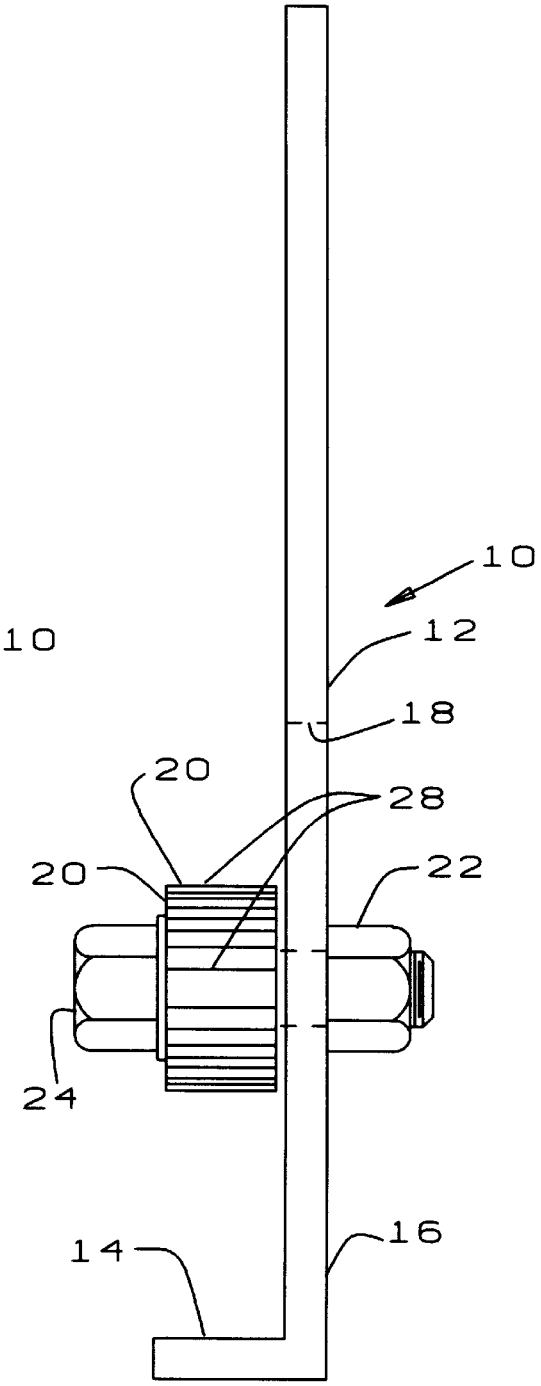
FIG. 2 is a front view of the tool of FIG. 1.

In that form of the present invention chosen for purposes of illustration, FIGS. 1 and 2 show a tool, indicated generally at 10, having an elongated handle 12 with a flange 14 located adjacent one end 16 of the handle 12 and projecting perpendicularly from handle adjacent, but spaced from, said one end 16. The handle 12 is formed with an opening 18, which is preferably elongated to enable the wheel 20 to be adjustably positioned, and a wheel 20 is secured to said handle, by suitable means, such as bolt 22 and nut 24, at a desired location along the slot 18 and the periphery 26 of the wheel 20 is provided with a friction surface, such as teeth 28.

Figure 3:
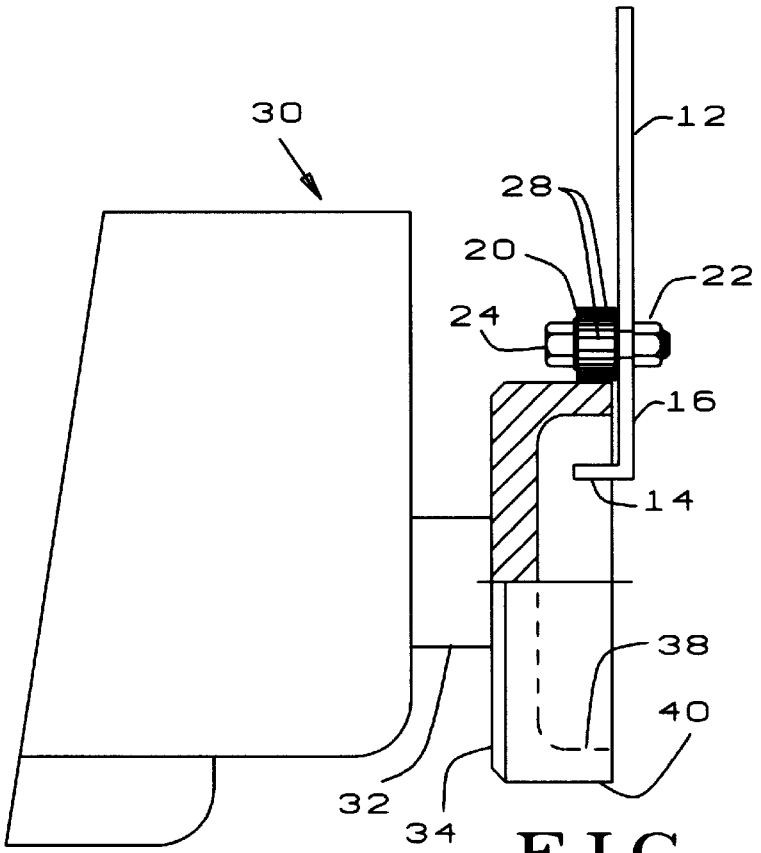
FIG. 3 is a diagrammatic representation showing the tool of FIG. 1 positioned to rotate a diesel engine.
Figure 4:
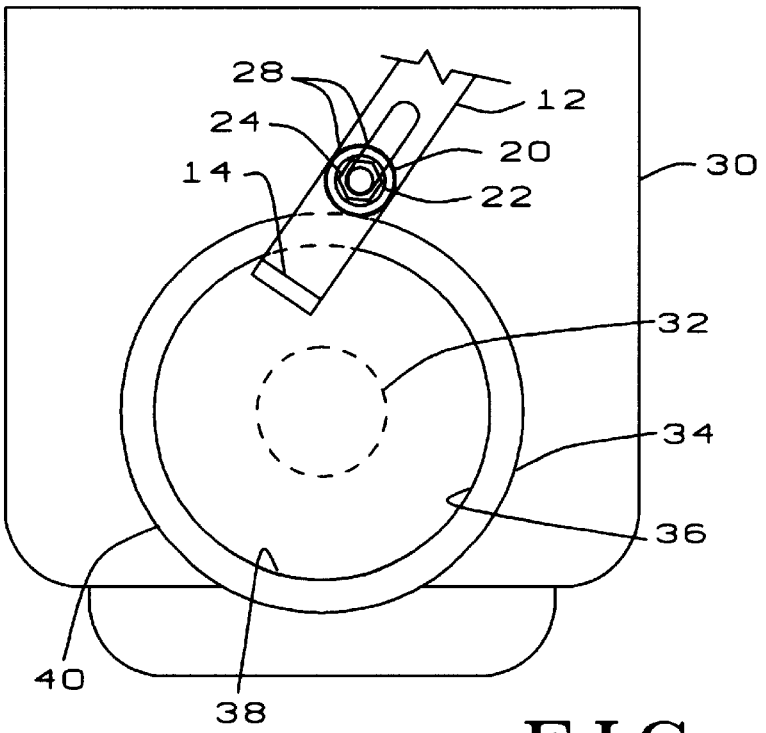
FIG. 4 is a right end view of the diesel engine of FIG. 3.

In use, as seen in FIG. 3, a diesel engine, indicated generally at 30 has an internal crankshaft, having an outer end 32, which projects out of the engine 30, and carries a wheel 34, called a "damper", having a peripheral flange 36, is fixedly secured to the outer end 32 of the crankshaft. To enable the mechanic to rotate the damper 34 and, hence the crankshaft 32, the mechanic places flange 14 of the tool 10 against the inner surface 38 of flange 36 of the damper wheel 34 and rotates handle 12. Thereafter, as the mechanic continues to rotate handle 12, wheel 20 will engage the outer surface 40 of flange 36 of the damper wheel causing teeth 28 of wheel 20 and flange 14 of the tool 10 to firmly grip flange 36 of the damper wheel 34 therebetween to rotate the damper wheel 20 and, hence, to rotate the crankshaft 32. With the leverage provided by handle 12, the mechanic can quickly and easily rotate the crankshaft 32 to a desired position with a high degree of accuracy.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A tool for rotating the crankshaft of a diesel engine, said tool comprising:

an elongated handle having a flange projecting perpendicularly adjacent one end thereof, and a gripping wheel having a toothed surface attached to said handle at a point spaced from said one end.

2. The tool of claim 1 wherein: said gripping member is pivotally connected to said handle.

3. The tool of claim 1 wherein: said handle is formed with an elongated slot located adjacent but spaced from said one end, and said gripping member is adjustably secured to said slot.

4. The tool of claim 1 wherein: said wheel has a surface formed for frictional engagement.

5. tool for rotating the crankshaft of an engine having a crankshaft with a flanged damper wheel projecting from one end of said engine, said tool comprising:

an elongated generally L-shaped handle having a flange located at the lower end thereof, a toothed wheel secured to said handle at a point spaced from said flange a distance such that, when said flange is inserted into the recess of said diesel engine damper, said toothed wheel will rest on the outer surface of said damper and, when said tool is rotated, said flange and said wheel will clamp said damper therebetween to rotate said damper and said engine.

6. The tool of claim 5 wherein:

said toothed wheel is pivotally connected to said handle.

7. The tool of claim 5 wherein:

said handle is formed with an elongated slot located adjacent but spaced from said one end, and said gripping member is adjustably secured to said slot.

8. The tool of claim 5 wherein:

said wheel has a surface formed for frictional engagement.

* * * * *